US007036538B2

(12) United States Patent
Schlosser

(10) Patent No.: US 7,036,538 B2
(45) **Date of Patent: *May 2, 2006**

(54) DEVICE FOR FILLING A BAG

(75) Inventor: Werner Schlosser, Hennef (DE)

(73) Assignee: Chronos Richardson GmbH, Hennef (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/933,347

(22) Filed: Sep. 3, 2004

(65) Prior Publication Data

US 2005/0133111 A1 Jun. 23, 2005

(30) Foreign Application Priority Data

Sep. 6, 2003 (DE) ..... 103 41 174

(51) Int. Cl.
*B67C 3/26* (2006.01)

(52) U.S. Cl. ..... 141/260; 141/250; 141/255; 141/259

(58) Field of Classification Search ..... 141/10, 141/67, 250, 255–260; 222/241, 246
See application file for complete search history.

(56) References Cited

U.S. PATENT DOCUMENTS

| | | | | |
|---|---|---|---|---|
| 1,248,610 | A * | 12/1917 | Caracristi | 414/323 |
| 5,988,234 | A * | 11/1999 | Wegman | 141/67 |
| 6,810,921 | B1 * | 11/2004 | Schlosser | 141/2 |

FOREIGN PATENT DOCUMENTS

| | | |
|---|---|---|
| DE | 35 20 492 C3 | 6/1996 |
| DE | 198 28 559 C1 | 3/2000 |
| DE | 199 62 475 A1 | 7/2001 |
| EP | 1 338 510 A | 8/2003 |

* cited by examiner

*Primary Examiner*—Timothy L. Maust
(74) *Attorney, Agent, or Firm*—Sughrue Mion, PLLC

(57) ABSTRACT

A device for filling a bag with bulk material. The device includes a charging hopper, a filling pipe adjoining the lower end of the charging hopper, a conveyor worm arranged in the filling pipe and drivingly connected to a rotary driving motor, as well as a height-adjustable closing element which is connected to the conveyor worm and which is arranged at the lower end of the filling pipe, wherein the rotary driving motor together with the conveyor worm and the closing element are arranged so as to be height-adjustable relative to the filling pipe.

12 Claims, 6 Drawing Sheets a)

b)

DEVICE FOR FILLING A BAG

BACKGROUND OF THE INVENTION

The invention relates to a device for filling a bag with bulk material, which device comprises a charging hopper, a filling pipe adjoining the lower end of the charging hopper, a conveyor worm arranged in the filling pipe and drivingly connected to a rotary driving motor, as well as a height-adjustable closing element which is connected to the conveyor worm and which is arranged at the lower end of the filling pipe. Devices of said type serve to fill bags in such a way that, by means of suitable handling means, a bag is first pulled over the filling pipe and held by suitable holding means at the filling pipe in such a way that the lower filling pipe ends near the bag base. When the bulk material begins to flow out of the opening at the lower end of the filling pipe after the closing element has been opened, the bag is increasingly lowered downwardly by the respective holding means until the respective filling level has been reached. Thereafter the closing element is closed again and the bag is completely pulled off the filling pipe in the downward direction by suitable handling means.

DE 198 28 559 C1 discloses a filling device of said type wherein a conveyor worm is arranged in the filling pipe at a fixed height and provided with a hollow worm-type shaft through which there passes a height-adjustable driveshaft for a closing element. The closing element is also rotatingly drivable, with the rotary motor of the closing element being connected to the driveshaft of the closing element so that its height is adjustable.

From DE 199 62 475 C2, there is known a device of the initially mentioned type wherein the closing element is firmly connected to the conveyor worm. By necessity, the height of the worm-type shaft of the conveyor worm is adjustable. There is provided a so-called torque ball bush and a linear bearing between a fixed hollow driveshaft and the worm-type shaft of the conveyor worm guided therein.

The torque ball bush and the linear bearing are easily subject to failure and have to be carefully sealed to prevent the penetration of bulk material dust.

It is therefore an object of the present invention to propose a device of said type whose design is simplified relative to the prior art devices.

SUMMARY OF THE INVENTION

The objective is achieved by a device for filling a bag with bulk material, which device comprises a charging hopper, a filling pipe adjoining the lower end of the charging hopper, a conveyor worm arranged in the filling pipe and drivingly connected to a rotary driving motor, as well as a height-adjustable closing element which is connected to the conveyor worm and which is arranged at the lower end of the filling pipe wherein the rotary driving motor together with the conveyor worm and the closing element are arranged so as to be height-adjustable relative to the fixed filling pipe. Such a solution, on the one hand, allows the use of one single driveshaft for the conveyor worm and the closing element, which two parts are connected to one another. On the other hand, it is advantageous that it is possible to eliminate said torque ball bush and the linear bearing because the common shaft for the conveying worm and the closing element is displaced together with its bearing. For this purpose, the invention, in a preferred embodiment, proposes a gate which is fixed relative to the filling pipe and in which there is arranged a height-adjustable lifting frame which accommodates the rotary driving motor for the conveyor worm and the bearing of the worm-type shaft of the conveyor worm.

The worm-type shaft can be driven by a coaxially arranged rotary driving motor constituting a direct drive. However, according to a preferred embodiment, there is provided a rotary driving motor in the lifting frame which is arranged on one side of the worm-type shaft and which, via a belt drive, acts on a gear located on the upper free end of the worm-type shaft.

For adjusting the height of said lifting frame, it is proposed according to a first alternative to arrange in the gate at least one upright spindle on which there runs a spindle nut which is firmly connected to the lifting frame. According to a first embodiment, the at least one spindle which is rotatingly drivable by a setting motor can serve to drive the lifting frame only which can then be slidingly guided on several, more particularly four vertical guiding pipes. According to a further embodiment, a plurality of two or more rotatingly drivable spindles can be arranged in the gate, on which spindles there run spindle nuts which are connected to the lifting frame and which then simultaneously serve guiding purposes and the setting drive of the lifting frame. The synchronous drive of the plurality of spindles can be effected via a belt drive or chain drive by a setting motor which is fixedly arranged in the gate.

For adjusting the height of said lifting frame, it is proposed according to a second alternative to provide at least one vertically arranged setting cylinder which is firmly connected to the gate and whose piston rod acts on the lifting frame. The setting cylinder is a double-acting setting cylinder for raising and lowering purposes which can be provided with a brake. In this case, too, the lifting frame can be slidingly guided on several, more particularly four, vertical guiding pipes.

To be able to set intermediate positions at the closing cone by means of the type of drive described here, it is proposed according to a further preferred embodiment to provide at least one vertically arranged abutment cylinder whose moved-out abutment piston holds the lifting frame against the upwardly directed lifting force of the setting cylinder in an intermediate position which, at the closing cone, ensures an open position for a reduced medium or fine material flow. In a standard case, there are provided two abutment cylinders which are able to move out their abutment pistons to different heights so that, starting from a maximum opening stroke of the closing cone for a coarse flow of material, a first abutment holds the closing cone in a position for the medium flow of material, with a second abutment holding the closing cone in a position for a fine flow of material, whereas if the two abutments are withdrawn, the setting cylinder is able to lift the closing cone into the closing position.

According to a further improvement, it is proposed that in the charging hopper, there is provided a stirring device which can be driven by a stirring motor via a sleeve through which the worm-type shaft of the conveyor worm passes coaxially. The passage of the worm-type shaft through the bush has to be suitably sealed towards the top and bottom.

In a further preferred embodiment, the stirring mechanism can be provided with blades comprising a pitch with reference to the axis of rotation of the stirring mechanism, which blades push the bulk material in the charging hopper downwards, with the stirring mechanism being rotatingly driven. More particularly, it is proposed that the pitch of the blades at the stirring mechanism and the pitch of the conveyor worm extend in opposite directions and that, accordingly both are rotatingly driven in opposite directions.

According to a further embodiment of the invention, it is proposed that the charging hopper comprises a double-wall annular portion with an air-permeable inner wall which forms a closed annular chamber connectable to an extraction pump to be able to extract, via the inner wall, air from the bulk material in the charging hopper. In this way it is possible to increase the packing density of the bulk material prior to filling a bag.

Preferred embodiments of the invention are illustrated in the drawings and will be described below.

DETAILED DESCRIPTION OF THE INVENTION

Figure 1:
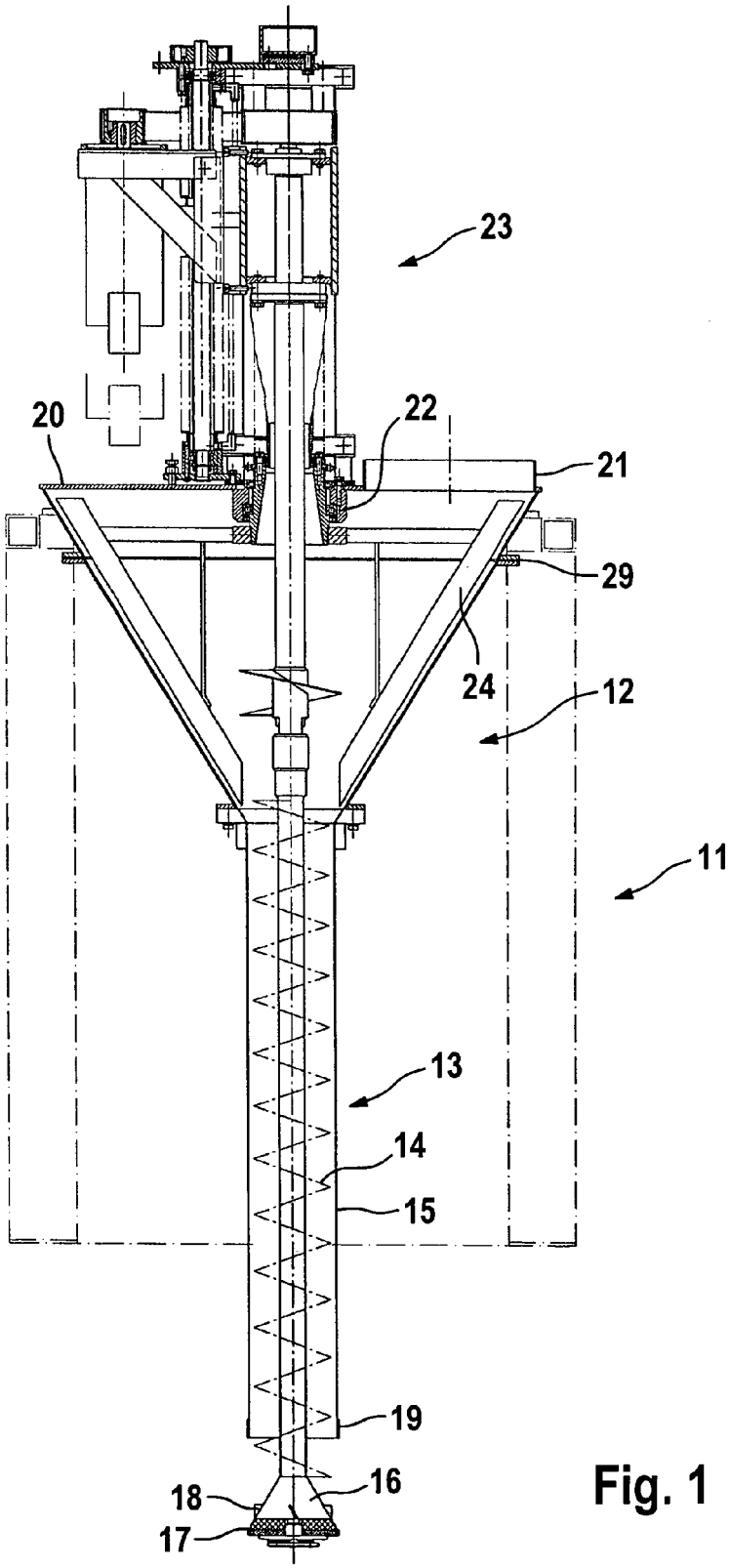
FIG. 1 is a vertical section view of a device for filling a bag and including an open closing element, according to a first embodiment of the invention.

Initially, FIGS. 1 and 2 will be described jointly. They each show a frame 11 in which there is suspended an inventive device which comprises a charging hopper 12 and a vertical filling pipe 13 adjoining same at its lower end. The filling pipe 13 contains a conveyor worm 14 with a worm-type shaft 15. At the lower end of the worm-type shaft 15 there is arranged a multi-component closing cone 16 showing a sealing region 17 and blades 18 on its conical upper face. The conveyor worm 14 with the closing cone 16 are shown in an open position. At the lower end of the filling pipe 13 there can be seen an abutment ring 19, with the sealing region 17 of the closing cone 16 resting there against in a closed position. The charging hopper 12 is covered by a cover plate 20 into which there is inserted a sleeve 21. The cover plate 20, in its centre, is provided with a passage 22 from which there emerges upwardly a multi-component worm-type shaft 15. On the cover plate 20 there is positioned a driving and setting device 23 for the conveyor worm 14 and the closing cone 16. Both are connected to one another in a rotationally fast way and rotatingly drivable. Furthermore, both are height-adjustable between the illustrated open position and the above-mentioned closed position, with the open position being suitable for conveying a flow of coarse material, and an intermediate position can be set between the open position and the closed position for conveying a flow of fine material. Inside the charging hopper 12, there is arranged a rotatingly drivable stirring mechanism 24. Whereas in FIG. 1 the charging hopper 12 is substantially entirely conical in shape and consists of two parts which are joined via a flanged connection 29 in a horizontal dividing plane, the charging hopper in FIG. 2 is, substantially, composed of three parts, with a cylindrical annular portion 46 being inserted via two flange connections 29', 29" between two parts corresponding to FIG. 1. Said annular portion 46 forms an annular space and comprises an air-permeable inner wall 49 which, more particularly, consists of a multi-layer wire mesh. Via sleeves 54 which adjoin the outside of the annular portion 46 and which can be connected to a suction pump air can be extracted from the bulk material in the charging hopper.

Figure 3:
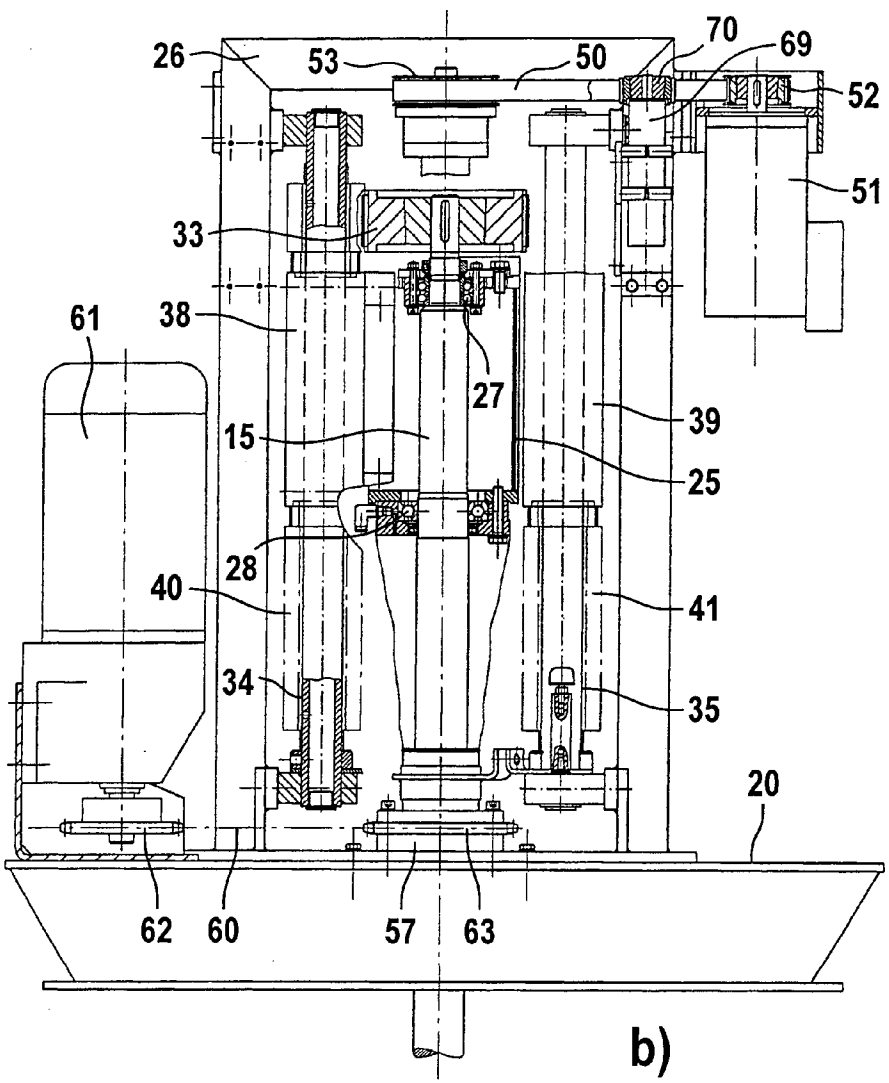
FIGS. 3(*a*) and 3(*b*) are detailed views showing the shaft drive of the conveyor worm and of the closing element and their setting device according to FIGS. 1 and 2, wherein FIG. 3(*a*) is a vertical sectional view and FIG. 3(*b*) is a vertical sectional view rotated 90° with respect to FIG. 3(*a*)
Figure 3:
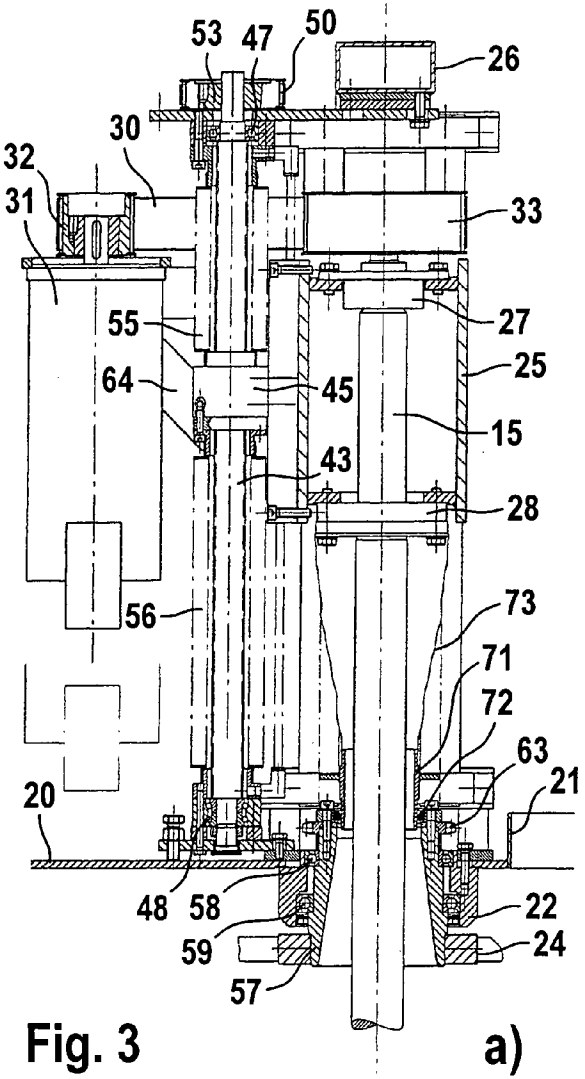

FIGS. 3(*a*) and 3(*b*) will be described jointly below. Of the details mentioned, it is possible to identify the cover plate 20, the passage 22, the sleeve 21 and the upper portion of the worm-type shaft 15. At its upper end, the worm-type shaft 15 is supported in a lifting frame 25 which is height-adjustably arranged in a gate 26 which is positioned on the cover plate 20. An axial bearing 27 and a radial bearing 28 holding the worm-type shaft 15 axially and radially are inserted into the gate 26. The shaft end leaves the axial bearing 27 upwardly. A gear 33 is fixed to the shaft end. The gear 33 is driven via a toothed belt 30 by a rotary driving motor 31 on whose shaft there is fixed a gear 32. The rotary driving motor 31 is firmly connected to the lifting frame 25 by holding means 64. Vertical guiding pipes 34, 35, 36, 37 on which the lifting frame 25 is guided by means of slides 38, 39 are inserted into the gate 26. Bellow sets 40, 41 (indicated only) protect the guiding pipes 34, 35 from bulk material dust. For adjusting the height of the lifting carriage 25, the gate 26 is provided with an upright spindle 43 which is rotatably supported in upper and lower bearings 47, 48. The spindle 43 is rotatingly drivable via a gear 53 fixed to the upper end of same. On the spindle 43 there is arranged a spindle nut 45 which is firmly connected to the lifting frame 25. The gear 53 is drivable via a toothed belt 50 which is driven by a setting motor 51 to the shaft end of which there is fixed a gear 52. The setting motor 51 is firmly arranged at the gate 26. The spindle 43 is sealed by bellows 55, 56 against bulk material dust. When the rotary motor 51 rotatingly drives in the one or other direction, the spindle 43 is rotated in the one or other direction via the toothed belt drive 50. When the spindle is rotated in the one or other direction, the spindle nut 45 on the spindle 43 is raised or lowered and thus the entire lifting frame is raised or lowered on the guiding pipes 34, 35. The worm-type shaft 15 and the rotary driving motor 31 are raised and lowered by the lifting carriage 25, so that the rotary drive of the worm-type shaft 15 can be maintained independently of the lifting movement of the worm-type shaft 15 and thus of the closing cone 16. The toothed belt 50 continues to run via the driving roller 70 and is fixed on the shaft end of the pneumatic motor 69. In respect of height, the pneumatic motor 69 is firmly arranged at the gate 26. In the case of a voltage failure at the setting motor 51, the lifting frame 25 together with the closing cone 16 can be moved by means of the pneumatic motor 69 into the closed position relative to the filling pipe 13. The controllability of the pneumatic motor has to be ensured.

A sleeve 57 is supported in the upper and lower bearings 58, 59 in the initially mentioned passage 22 to which there are secured the above-mentioned stirring arms 24. On the sleeve 57, there is positioned a chain gear 63 which can be driven via a driving chain 60 (indicated in dashed lines only) by a stirring motor 61 provided with a chain gear 62. The stirring motor 61 is fixed on the cover plate 20 by holding means 65 separately from the gate 26. Into the sleeve 57 there is inserted a sleeve 71 which is sealed via an annular seal 72 relative to the sleeve 57. The sleeve 71 is followed by bellows 73 which are sealingly connected to the bearing carrier of the radial bearing 28.

Figure 2:
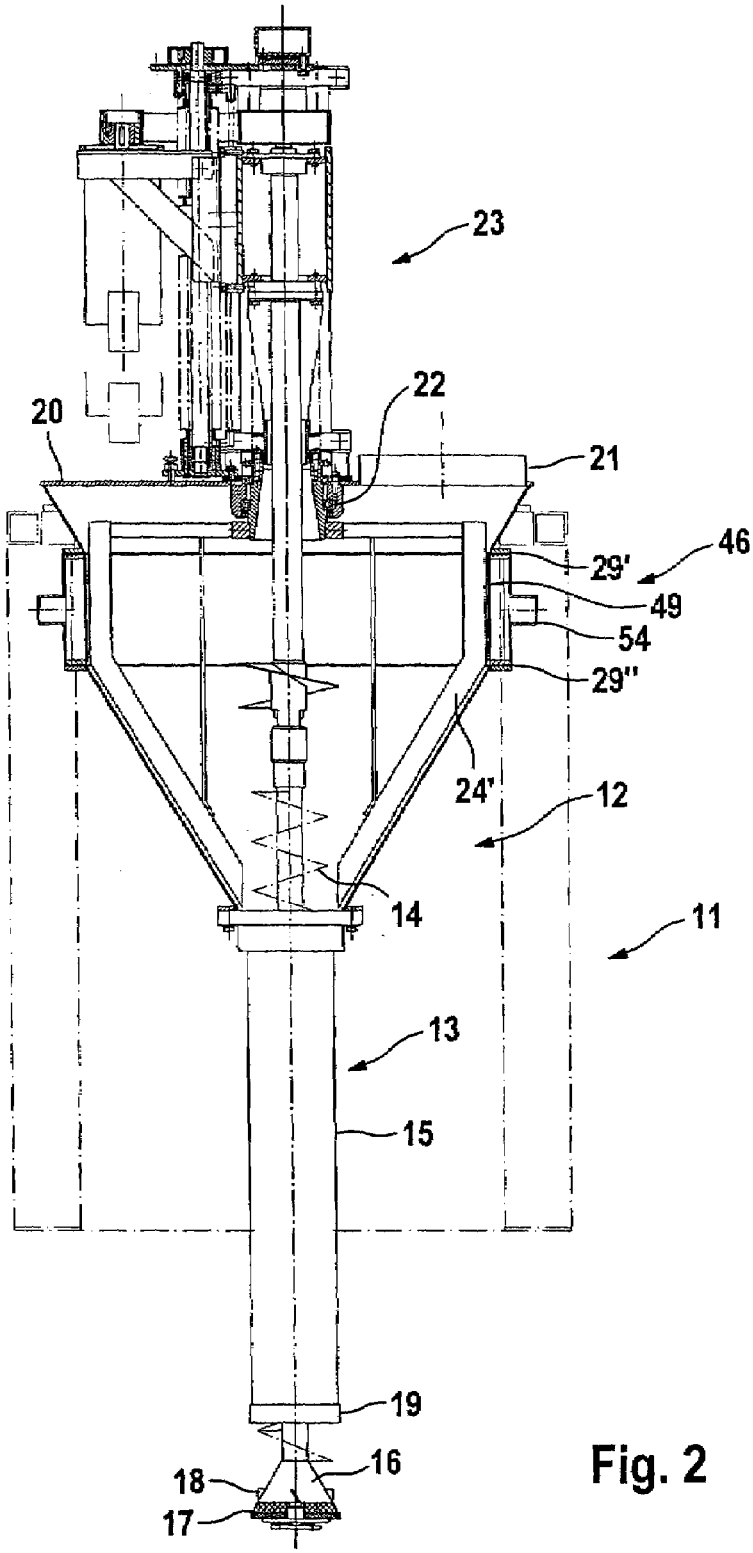
FIG. 2 is a vertical section view of a device for filling a bag and including an open closing element, according to a second embodiment of the invention.
Figure 4:
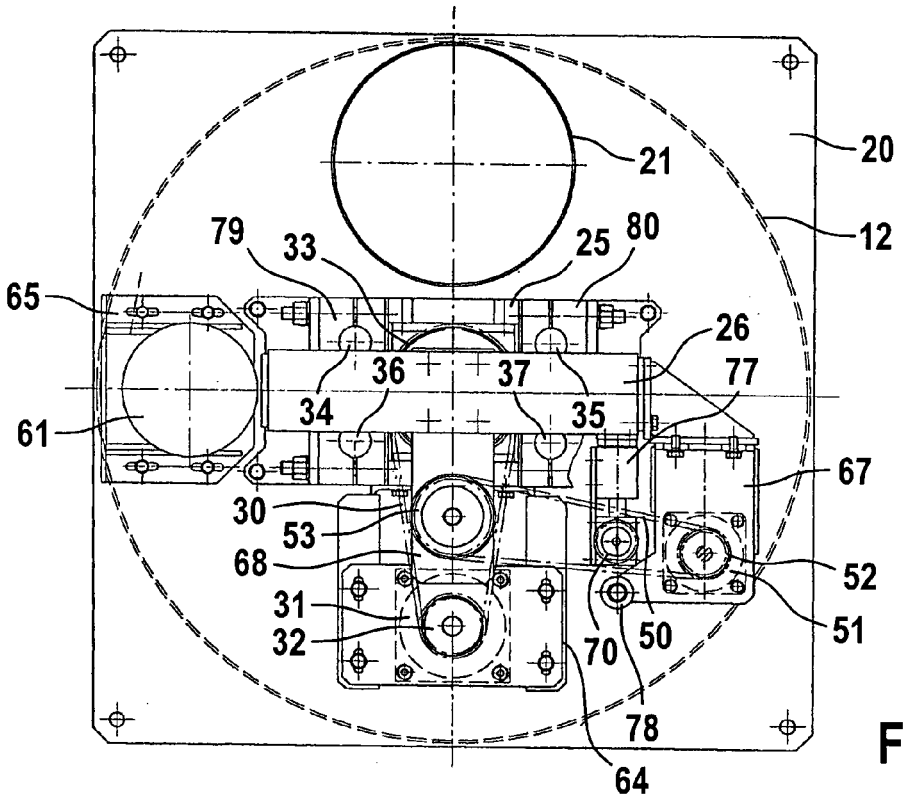
FIG. 4 is a plan view of the driving device shown in FIG. 3(*b*)

FIG. 4 shows the same details as FIGS. 1 to 3 with the same reference numbers. As far as details are concerned, it is possible to see the charging hopper 12, the cover plate 20 and the sleeve 21. The gate 26 in which the lifting carriage 25 is guided vertically is positioned on the cover plate 20. It is possible to see the upper bearings 79, 80 of four guiding pipes 34, 35, 36, 37. The holding means 64 are bolted to the lifting frame 25 and receive the rotary driving motor 31 which, by means of the gear 32, via the toothed belt 30, drives the gear 33 fixed on the worm-type shaft. The setting motor 51 which, by means of the gear 52, via the toothed belt 50, drives the gear 53 fixed on the spindle is arranged in further holding means 67 which are firmly connected to the gate 26. The spindle 43 is held in holding means 68 connected to the gate 26. In addition to the gate 26, it is possible to see the holding means 65 with the stirring motor 61. Inside the toothed belt 50, there is positioned the driving roller 70 of the pneumatic motor 69. By means of a pneumatic cylinder 77 secured to the gate 26, these are jointly horizontally displaceable in such a way that the driving roller 70 presses the toothed belt 50 against a counter roller 78.

Figure 5:
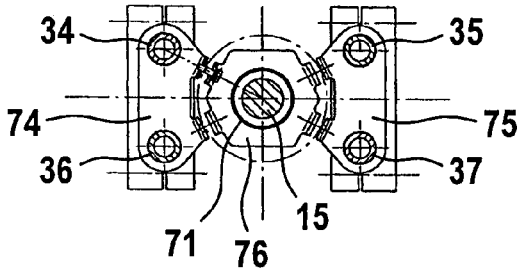
FIG. 5 is a cross-sectional view of the device shown in FIG. 4.

FIG. 5 shows a section through the sleeve 71 which is held in a holding plate 76 which is settable by four screws and is inserted into two lugs 74, 75 which are held on the guiding pipes 34, 35, 36, 37.

Figure 6:
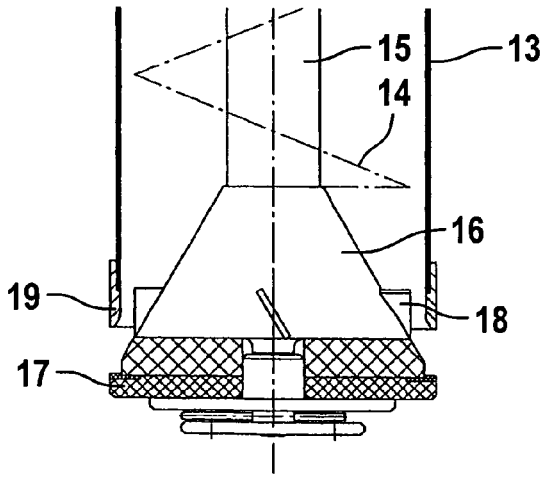
FIG. 6 is a detailed view showing the closing element according to FIGS. 1 and 2.

FIG. 6 shows the lower end of the filling pipe 13 with the closing cone 16 which, in this Figure, is held in an intermediate position for a fine material flow, with a small annular gap being held open relative to the abutment ring 19. When being driven rotatingly, the blades 18 arranged at an angle relative to the axial direction convey a fine flow of material through said annular gap.

Figure 7:
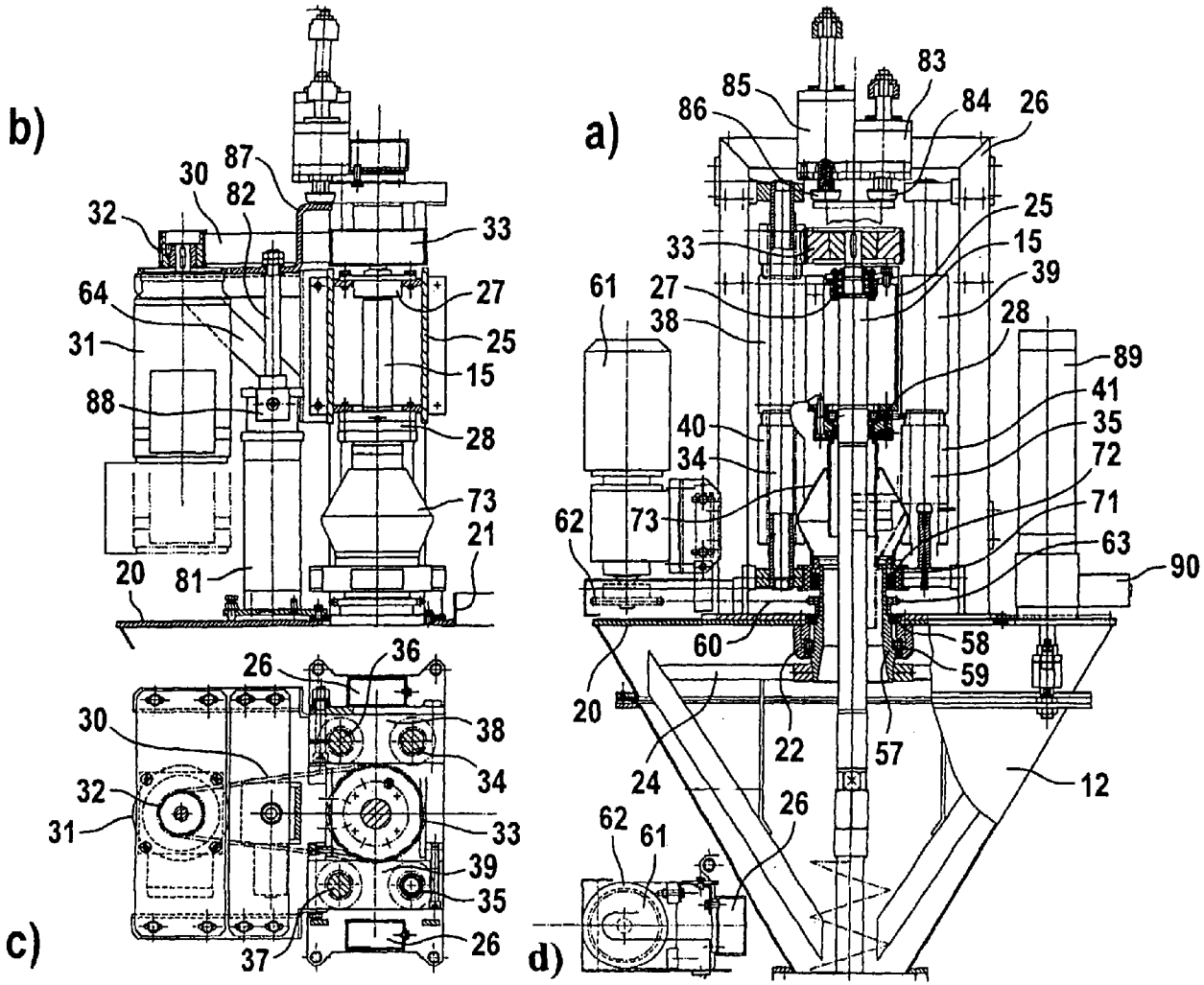
FIGS. 7(*a*), 7(*b*), 7(*c*) and 7(*d*) show the shaft drive of the conveyor worm and of the closing element and their setting device in yet another embodiment of the invention, wherein FIG. 7(*a*) is a vertical sectional view, FIG. 7(*b*) is a vertical sectional view rotated 90° with respect to FIG. 7(*a*) and FIG. 7(*c*) is a plan view of the setting device and FIG. 7(*d*) is a plan view of the stirring motor.

FIGS. 7(*a*), 7(*b*), 7(*c*) and 7(*d*) will be described jointly below. In principle, reference is made to the description of the previous Figures. As far as details are concerned, it is possible to identify the cover plate 20, the passage 22, the sleeve 21 as well as the upper portion of the worm-type shaft 15. By means of its upper end, the worm-type shaft 15 is supported in a lifting frame 25 which is height-adjustably arranged in a gate 26 which is positioned on the cover plate 20. An axial bearing 27 and a radial bearing 28 holding the worm-type shaft 15 axially and radially are inserted into the gate 26. The shaft end leaves the axial bearing 27 in the upward direction. A gear 33 is fixed to the shaft end. The gear 33 is driven via a toothed belt 30 by a rotary driving motor 31 on whose shaft there is fixed a gear 32. The rotary driving motor 31 is firmly connected to the lifting frame 25 by means of holding means 64. Vertical guiding pipes 34, 35, 36, 37 on which the lifting frame 25 is guided by means of slides 38, 39 are inserted into the gate 26. Bellow sets 40, 41 (indicated only) protect the guiding pipes from bulk material dust. For adjusting the height of the lifting frame 25, a double acting setting cylinder 81 which is arranged in an upright position and whose piston rod 82 acts on the holding means 64 is arranged on the cover plate 20. The setting cylinder 81 is provided with a brake 88. The setting cylinder 81 effects the vertical adjustment of the lifting frame 25 on the guiding pipes 34, 35, 36, 37. The lifting frame 25 is used to raise or lower the worm-type shaft 15 and the rotary driving motor 31, so that the rotary drive of the worm-type shaft 15 can be maintained without being affected by the lifting movement of the worm-type shaft 15 and thus of the closing cone 16. When the brake 33 is released and when the setting cylinder 81 is moved into its lower position, the worm-type shaft 15 together with the closing cone 16 are moved into the lowermost maximum open position, so that a maximum flow of coarse material can be released. Before the setting cylinder 81 with the piston rod 82 is moved upwards in the opposite direction, first, two abutment cylinders 83, 85 are actuated whose abutment pistons 84, 86 are shown in the closed position of the closing cone. A lug 87 of the holding means 64, which lug 87 is directly connected to the piston rod 82, stops against the abutment pistons 84, 86. In the downwardly moved-out position, the abutment piston 86 is positioned at a lower level than the abutment piston 84, so that the upwardly moving lifting frame 25, by means of the lug, first stops against the abutment 86, as a result of which there is set an intermediate position at the closing cone for a piston permitting a medium flow of material. When the abutment piston 86 of the abutment cylinder 85 is then withdrawn into the position illustrated in the drawing, the lug 87 stops against the abutment piston 84 in the moved-out position, as a result of which an intermediate position for a fine flow is set a the closing cone. Only when the abutment piston 84 of the abutment cylinder 83 is returned into the position illustrated in the drawing, does the piston rod 82 lift the lifting carriage 25 back into the closed position of the closing cone.

In the initially mentioned passage 22, there is supported a sleeve 87 in lower and upper bearings 58, 59, with the above-mentioned stirring arms 24 being secured to said sleeve 87. A chain gear 63 which can be driven via a driving chain 60 (indicated by dashed lines only) by a stirring motor provided with a chain gear 62 is positioned on the sleeve 57. The stirring motor 61 is secured separately from the gate 26 on holding means 65 on the cover plate 20. A sleeve 71 which is sealed by an annular seal 72 relative to the sleeve 57 is positioned on the sleeve 57. The sleeve 71 is followed by bellows 73 which are sealingly connected to the longitudinal carrier of the radial bearing 28.

The lifting cylinder 89 with a brake 90 serves to lower the charging hopper 12 for cleaning purposes.

Figure 8:
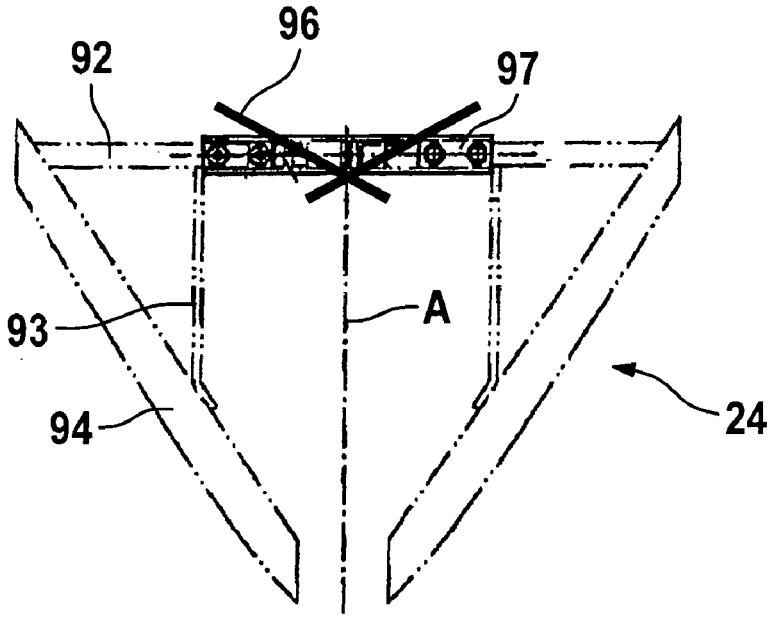
FIGS. 8(*a*) and 8(*b*) show the stirring mechanism in the form of a detail (in dashed lines) with additional blades, wherein FIG. 8(*a*) is a side view and FIG. 8(*b*) is a plan view.
Figure 8:
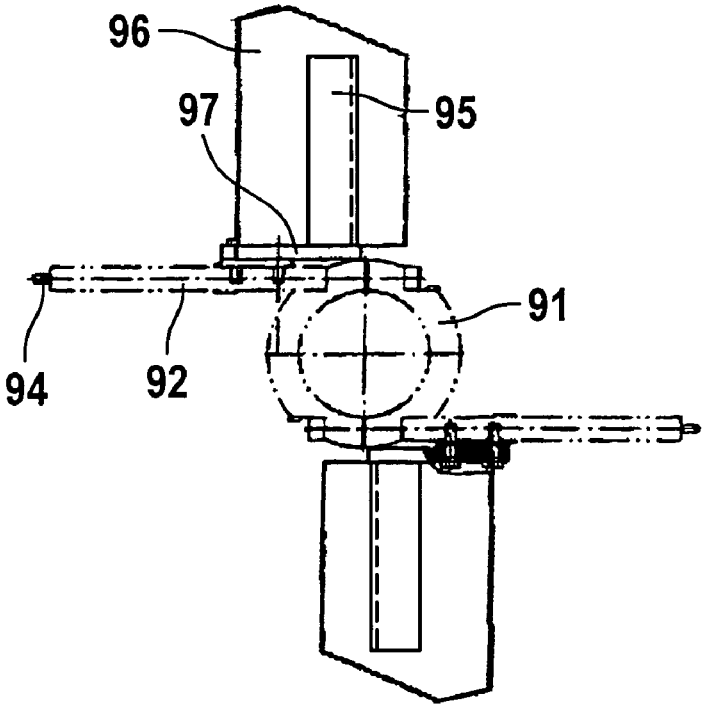

FIGS. 8(*a*) and 8(*b*) will be described jointly below. They show a set of stirring arms 24 with its holding means in dashed lines, also showing additional blades. The holding means for the stirring arms comprise a two-part ring 91 which can be clamped on to the sleeve 57. To the ring 91, there are attached tangentially arranged holding arms 92 and struts 93 which hold the stirring blades 94 of the stirring arms 24. Furthermore, holding means 97 to which there are secured simple angle profiles 92 arranged approximately radially relative to the ring 91 are bolted to the holding arms 92. The angle profiles 95 arranged opposite one another in pairs each carry blades 96 which are arranged at a pitch relative to the axis of rotation A of the stirring mechanism 24. The pitch and thus the direction of rotation of said blades are to extend in opposite directions relative to the pitch and direction of rotation of the conveyor worm.

What is claimed is:

1. A device for filling a bag with bulk material, comprising:

a charging hopper (12);

a filling pipe (13) adjoining the lower end of the charging hopper (12);

a conveyor worm (14) arranged in the filling pipe (13) and drivingly connected to a rotary driving motor (31); and a height-adjustable closing element (16) which is connected to the conveyor worm (14) and which is arranged at the lower end of the filling pipe (13), wherein the rotary driving motor (31) together with the conveyor worm (14) and the closing element (16) are arranged so as to be height-adjustable relative to the filling pipe (13).

2. A device according to claim 1, further comprising a gate (26) which is fixed relative to the filling pipe (13) and in which there is arranged a lifting frame (25) so as to be height-adjustable, which lifting frame (25) carries the rotary driving motor (31) and the bearing (27, 28) of a worm-type shaft (15) of the conveyor worm (14).

3. A device according to claim 1, further comprising a plurality of vertical guiding bars (34, 35, 36, 37) on which the lifting frame (25) is guided displaceably.

4. A device according to claim 1, further comprising at least one upright spindle (43);

a setting motor (51) for rotatably driving the spindle, the spindle (43) being fixedly arranged in the gate (26); and a spindle nut (25) fixedly arranged in the lifting frame (25), the spindle nut running on the spindle.

5. A device according to claim 1, further comprising two spindles (43) provided on which the lifting frame (25) and directly vertically guided on two spindle nuts (45).

6. A device according to claim 1, further comprising at least one vertically arranged setting cylinder (81) which is firmly connected to the gate (26) and whose piston rod (82) acts on the lifting frame (25).

7. A device according to claim 1, further comprising at least one vertically arranged abutment cylinder (83, 85) whose moved-out abutment piston (84, 86) holds the lifting frame (25) against the upwardly directed lifting force of the setting cylinder (81) in an intermediate position which, at the closing cone (16) effects an open position for a reduced central material flow or fine material flow.

8. A device according to claim 1, further comprising a stirring mechanism (24) in the charging hopper (12) which is drivable by a stirring motor (61) via a sleeve (59) through which there passes the worm-type shaft (15) of the conveyor worm (14).

9. A device according to claim 1, further comprising a charging hopper (12') which comprises a double-wall annular portion with an air-permeable inner wall for extracting air from the charging hopper.

10. A device according to claim 4, further comprising a pneumatic motor (69) for driving the closing element (16) in an emergency if there is a voltage failure at the setting motor (51), which pneumatic motor (69) is drivingly connected to the spindle (43).

11. A device according to claim 8, wherein at the stirring mechanism (24), there are attached blades (96) having a pitch relative to the axis of rotation.

12. A device according to claim 11, wherein the conveyor worm (14) on the one hand and the blades (96) at the stirring mechanism (24) on the other hand comprise oppositely directed pitches and oppositely directed rotary driving directions.

* * * * *